United States Patent [19]

Norris et al.

[11] 4,099,393

[45] Jul. 11, 1978

[54] SPACE PRINT HEAD DRAW ROLLS

[75] Inventors: Alan Hedley Norris; Edwin Dwain Cromer; Phillip Wayne Chambley, all of Rome, Ga.

[73] Assignee: Champion International Corporation, Stamford, Conn.

[21] Appl. No.: 815,080

[22] Filed: Jul. 13, 1977

Related U.S. Application Data

[63] Continuation of Ser. No. 696,637, Jun. 16, 1976, abandoned.

[51] Int. Cl.[2] ..... D06B 1/14; D06B 15/02

[52] U.S. Cl. ..... 68/22 R; 28/169; 68/202; 100/121; 118/70; 134/122 R

[58] Field of Search ..... 68/22 R, 99, 244, 13 R, 68/202, 203, 212; 28/72.16; 118/70, 104, 117; 15/256.51; 100/121; 29/121.3; 162/358; 134/64 R, 64 P, 122 R, 122 P; 226/186, 193; 101/116–120

[56] References Cited

U.S. PATENT DOCUMENTS

| | | | |
|---|---|---|---|
| 1,296,112 | 3/1919 | Peiler | 100/121 X |
| 1,492,563 | 5/1924 | Headson | 29/121.3 X |
| 1,836,243 | 12/1931 | Haug | 29/121.3 X |
| 2,888,074 | 5/1959 | Hornbostel | 162/358 X |
| 3,198,696 | 8/1965 | Justus | 100/121 X |
| 3,237,433 | 3/1966 | Doleman et al. | 68/22 R |
| 3,826,713 | 7/1974 | Nykopp | 162/358 X |
| 3,910,230 | 10/1975 | Mercer | 68/22 R X |

FOREIGN PATENT DOCUMENTS

| | | | |
|---|---|---|---|
| 297,736 | 4/1971 | U.S.S.R. | 162/358 |

*Primary Examiner*—Philip R. Coe
*Attorney, Agent, or Firm*—Evelyn M. Sommer

[57] ABSTRACT

Space print head draw rolls for use as part of a dye application print station for the application of dye paste to yarn comprises first and second counter-rotating rolls in mechanical engagement with each other, whereby the yarn is gripped between the rolls and advanced therethrough. The first roll includes a core and a wire mesh sheath covering the exterior surface of the core. The second roll includes a core having a resilient covering on its exterior surface.

9 Claims, 3 Drawing Figures

SPACE PRINT HEAD DRAW ROLLS

This is a continuation division of application Ser. No. 696,637, filed June 16, 1976, and now abandoned.

BACKGROUND OF THE INVENTION

The subject invention relates to space print head draw rolls which function as a part of a dye application print station for space dyeing yarn, knit-de-knit tubing or weave-de-weave tapes. A typical print station comprises a feed roll, a print mechanism and exit or draw rolls. The feed rolls and exit rolls function to maintain tension in the yarn to be printed while it is in the print zone, and also to advance the yarn through the print station. The feed roll system generally consists of a pair of tubular members superposed over one another, and rotating in opposite directions. The exit roll system generally has the same configuration. In operation, yarn is gripped between the pair of feed rolls, and advanced therethrough, passing the print mechanism where the dye paste is applied to the fabric. The yarn is then gripped between the exit rolls and advanced therethrough. Generally the exit rolls handle material which contains up to 200% of its own weight of dye paste. This has led to a shortcoming which has been associated with existing print stations. In order to advance the yarn, the exit rolls must grip and pull it. As the rolls grip the yarn, they squeeze it, thereby spreading the dye paste, mixing dyes, and changing the printed pattern.

It is an object of the subject invention to provide exit rolls which will not displace the dye paste and yet allow a positive grip on the yarn so as to advance it, and maintain tension in the yarn while it is in the print zone.

SUMMARY OF THE INVENTION

The space print head draw rolls of the subject invention comprise first and second counter-rotating rolls. The first roll has a link wire mesh sheath covering its outside surface. A washing system is disposed over this first roll in such a position that the roll, after it has made contact with the dyed yarn, is washed clean of the dye paste. A drain is positioned underneath this first roll for collecting the excess water and dye paste. After the water and dye paste is drained, the roll passes under an air knife which dries the roll and places it in condition to again come in contact with more dyed yarn. This first roll is preferably made by rolling a sheet of stainless steel wire conveyor belt into a tubular member, forming a wire mesh sheath the size of the roll core. The wire mesh sheath is then slid over the roll core, and the ends of the sheath and the roll core are welded together.

The second roll is superposed above the first roll, and makes contact therewith. In operation, the rolls rotate in opposite directions. The second or upper roll has a smooth rubbercovered surface. A washing system is disposed at a position as as to wash this second roll after it has come in contact with the dyed yarn. After the rolls has been washed, a doctor knife scrapes the surface of the roll and channels the excess water and scraped dye paste into a drain which is connected to the doctor knife. As a result, the roll has been thoroughly cleaned and may again come into contact with the dyed yarn without applying any dye paste which had been absorbed from the previous contact.

Because there is only a small area of wire-to-rubber contact between the rolls, the dye paste is not displaced and spread to destroy the printed pattern. The configuration of the rolls also allows positive grip on the yarn to advance it therethrough and also maintains adequate tension on the yarn while it is in the print zone.

DESCRIPTION OF THE PREFERRED EMBODIMENT

The subject invention relates to a new and improved set of space print head draw rolls. These draw rolls function as part of a dye application print station for space dyeing yarns, knit-de-knit tubing or weave-de-weave tapes. A typical print station comprises a feed roll, a print mechanism, and exit or draw rolls.

Figure 1:
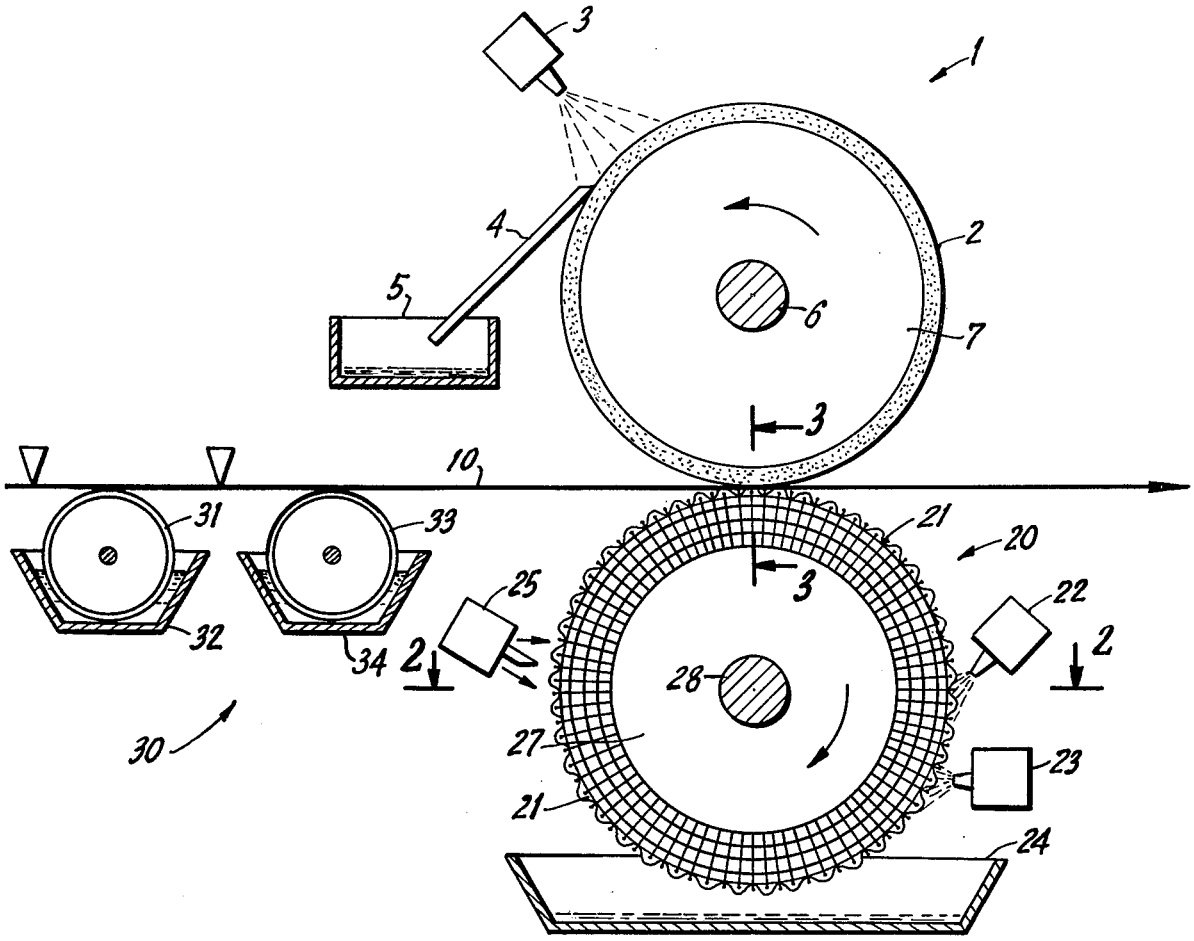
FIG. 1 is an elevational view of the draw rolls of the subject invention.
Figure 2:
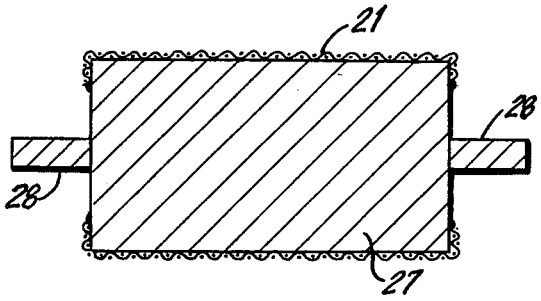
FIG. 2 is a cross-sectional view of the draw rolls of the subject invention, taken along line 2-2 of FIG. 1.
Figure 3:
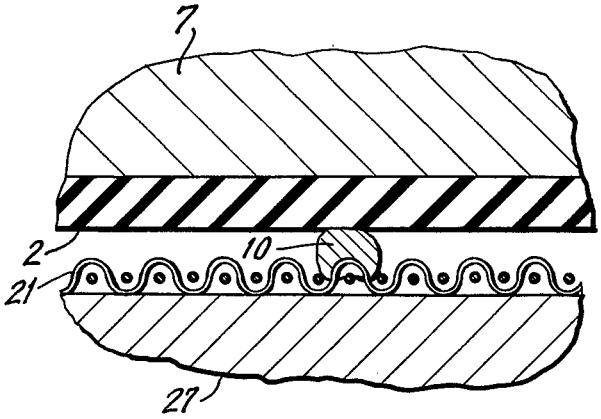
FIG. 3 is an enlarged cross-sectional view of the draw rolls of the subject invention, taken along line 3-3 of FIG. 1.

Referring to FIG. 1, there is depicted a print mechanism 30 which is standard in the industry. This print mechanism 30 includes two print rolls 31, 33 and two print vessels 32, 34. The print vessels 32, 34 contain the dye paste to be applied to the yarn. As can be seen in the drawings a portion of the print rolls 31, 33 is submerged in the print vessels 32, 34. Consequently, as the print rolls 31, 33 rotate they absorb the dye paste contained in the vessels 32, 34, and apply the dye paste to the passing yarn 10. As is depicted in FIG. 1, the yarn 10 is in tension as it passes the print mechanism 30. This tension is necessary to effectively print the desired pattern on the yarn 10. The tension is controlled by the feed rolls (not depicted) and the draw rolls 1 and 20.

Further referring to FIG. 1, there is depicted the exit or draw roll system of the subject invention comprising first and second counter-rotating rolls 1 and 20. The first roll 20 is preferably made by shaping a length of stainless steel link wire conveyor belt into a tubular member, forming a wire mesh sheath 21 the size of the roll core 27. This link wire mesh sheath 21 is then slid over the roll core 27, the ends of the wire sheath 21 and the roll core 27 being welded together. A shaft 28 for rotating roll 20 is also included.

Further referring to FIG. 1, two water sprayers 22, 23 are included to wash the bottom roll 20 after it has made contact with the dyed yarn 10. Although two sprayers are depicted it is clear that one or several sprayers, as desired, may be used. A drain 24 is disposed beneath the bottom roll 20 is collect the excess water and dye paste that has been washed from the surface of the bottom roll. Once the bottom roll 20 has been washed by these sprayers 22, 23, and the excess water and dye paste drained into drain 24, the roll comes into contact with an air knife 25, which dries the roll 20 and prepares it for recontacting the dyed yarn.

Superposed above the first roll 20, and mechanically engaged therewith is the second roll 1 of the subject invention. This second roll 1 comprises a roll core 7 preferably having a smooth rubber covering 2 over its exterior surface. Any resilient substance that will permit mechanical engagement with the first roll 20 may be used in lieu of rubber. This resilient surface 2 engages the wire surface 21 of the bottom roll 20, to advance the dyed yarn 10 through rolls 1, 20 and to aid in maintaining the necessary tension on the yarn 10 while it is passing through the print zone. A shaft 6 is provided for rotating roll 1. It should be noted that although shafts 28 and 6 are included for rotating rolls 20 and 1 respectively, any known manner of effecting the counter-rotation of rolls 20 and 1 may be used.

Further included with the second or upper roll 1 is a water sprayer 3 which washes the roll 1 after it has made contact with the dyed yarn 10. Of course, any desired number of sprayers may be used. A doctor knife is preferably provided for scraping the surface 2 of roll 1, after it has been washed, thus removing any excess water and dye paste from the roll 1. The doctor knife 4 also channels the excess water and dye paste into a connected drain 5.

In operation, the yarn 10 is advanced by the feed rolls (not depicted) to the print mechanism 30. As mentioned above, tension is maintained on the yarn 10 while it is in the print zone by the feed rolls and the draw rolls 1 and 20. After the dye paste has has been applied to the yarn 10, the yarn 10 is gripped between the draw rolls 1 and 20. As depicted in FIG. 1, draw rolls 1 and 20 rotate in opposite directions, roll 1 rotating in a counter-clockwise direction; roll 20 rotating in a clockwise direction. This rotation causes rolls 1 and 20 to grip the yarn 10 and advance it through the rolls. Because of the construction of rolls 1, 20 there is only a minimal area of wire-to-rubber contact therebetween, and much of the excess dye paste falls between the wire links to the roll core 27 of the first roll 20, beneath the wire sheath 21. As a result, the dye paste is not displaced and spread to destroy the printed pattern, yet there is a positive grip on the yarn 10. In addition, each roll 1 and 20 is thoroughly cleaned before recontacting the dyed yarn 10. Consequently, no dye paste which was absorbed by the rolls during the first contact with the dyed yarn 10 remains to mix with the new dye paste and printed pattern upon subsequent contact with dyed yarn 10.

In summary, the subject invention provides new and improved space print head draw rolls which effectively grip and advance the dyed yarn without displacing any dye paste or causing distortion to the printed pattern on the yarn. In addition, the subject invention provides a system whereby the draw rolls are thoroughly cleaned after making initial contact with the dyed yarn and before recontacting the dyed yarn. This effectively eliminates unwanted mixture of colors and destruction of printed patterns.

As is readily apparent, the subject invention thus conceived is succeptible to various modifications, alterations, and changes, all of which are to be considered as included within the scope of the invention as defined by the appended claims.

What is claimed is:

1. In a yarn space dyeing apparatus comprising a print mechanism for applying dye in a controlled pattern to yarn passing into contact therewith under tension between a feed roll and the nip of a first and second draw roll, said print mechanism including at least one print roll in communication with dye paste-containing vessel for spreading the dye paste on the yarn in a controlled pattern, said draw rolls including first and second counter-rotating rolls mechanically engaged with each other, said first roll including a core and a link wire sheath covering the exterior surface of said core, the links of said wire sheath being spaced apart to provide a coarse mesh and discrete points of substantially tangential contact between said first and second rolls; said second roll including a core and a resilient covering on the exterior surface of said second roll core; and means for rotating said first and second rolls in opposite directions whereby said draw rolls maintain tension in and advance the dye pasted yarn without displacing the pattern of the dye paste contained on said yarn.

2. Apparatus as recited in claim 1 further comprising means for cleaning the first roll after it has made contact with the dyed yarn.

3. Apparatus as recited in claim 2 in which the means for cleaning the first roll include a water sprayer disposed adjacent the periphery of the second roll, and contacting the second roll after it has made initial contact with the dyed yarn and before it recontacts the dyed yarn.

4. Apparatus as recited in claim 3 further including means, disposed adjacent the periphery of the first roll, for collecting the water and dye washed from said first roll.

5. Apparatus as recited in claim 3 further including an air knife, disposed adjacent the periphery of the first roll, for drying and further cleaning said first roll after it has been washed and before it recontacts the dyed yarn.

6. Apparatus as recited in claim 1 further comprising means for cleaning the second roll after it has made contact with the dyed yarn.

7. Apparatus as recited in claim 6 in which the means for cleaning the second roll after it has made contact with the dyed yarn include a water sprayer, disposed adjacent the periphery of the second roll, for cleaning the second roll after it has made initial contact with the dyed yarn and before said second roll recontacts the dyed yarn.

8. Apparatus as recited in claim 7 further including a doctor knife for scraping the exterior surface of the second roll after the second roll has been cleaned by the water sprayer and before the second roll recontacts the dyed yarn.

9. Apparatus as recited in claim 8 in which a drain is attached to the doctor knife for collecting the scraped water and dye paste.

* * * * *